United States Patent [19]

Dugan et al.

[11] 4,054,512

[45] Oct. 18, 1977

[54] DEASPHALTING WITH LIQUID HYDROGEN SULFIDE

[75] Inventors: John J. Dugan; Jackson Eng, both of Sarnia, Canada

[73] Assignee: Exxon Research and Engineering Company, Linden, N.J.

[21] Appl. No.: 734,744

[22] Filed: Oct. 22, 1976

[51] Int. Cl.[2] ..... C10G 21/06

[52] U.S. Cl. ..... 208/309

[58] Field of Search ..... 208/251 R, 252, 309

[56] References Cited

U.S. PATENT DOCUMENTS

| | | | |
|---|---|---|---|
| 2,163,245 | 6/1939 | Laughlin | 208/309 |
| 3,472,760 | 10/1969 | Paterson | 208/252 |
| 3,622,505 | 11/1971 | Tilley | 208/252 |

*Primary Examiner*—Herbert Levine

*Attorney, Agent, or Firm*—Edward M. Corcoran

[57] ABSTRACT

An asphalt-containing mineral oil is deasphalted by contacting the oil with a liquid hydrogen sulfide deasphalting solvent for a time sufficient to remove a substantial portion of the asphalt from the oil. Utilization of liquid hydrogen sulfide as the deasphalting solvent is capable of giving high yields of deasphalted oil. In contrast to the use of aliphatic solvents for deasphalting, the hydrogen sulfide readily mixes with the heavy feed even at relatively low temperatures.

10 Claims, No Drawings

DEASPHALTING WITH LIQUID HYDROGEN SULFIDE

BACKGROUND OF THE INVENTION

1. Field of the Invention

This invention relates to a process for deasphalting an asphalt-containing mineral oil. More particularly, this invention relates to contacting an asphalt-containing heavy petroleum oil feed with a liquid hydrogen sulfide deasphalting solvent for a time sufficient to separate a substantial portion of the asphalt from the oil.

2. Description of the Prior Art

The residual fraction or residuum resulting from atmospheric or vacuum distillation of crude oil contains high viscosity, high boiling point petroleum oil fractions useful for heavy duty lubricants for tractors, automotive, automobile and aircraft services, etc. These relatively heavy, high viscosity fractions are also useful as cracking feeds for the production of lighter, lower boiling lube and fuel components. However, in order to produce useful lube or cracker stocks from residuum, the asphaltenes must first be removed therefrom. These asphaltenes are black, solid substances at room temperature and contain most of the metals and sulfur present in the residuum. The asphalt produced from the residuum can be blended with lighter components into relatively heavy fuel oil stocks, can be used as a coking aid in various refinery coking processes, can be sold as is or can be air blown or oxidized to produce asphalt of improved flexibility, greater resistance to weathering and decreased brittleness which is useful for the production of roofing and road materials.

Solvent deasphalting of residuum is well known in the art and many solvents and solvent combinations have been suggested and used for the deasphalting thereof. Most commonly, nonpolar, light hydrocarbon solvents containing 3 to 8 carbon atoms in the molecule such as propane, propylene, butene, butane, pentene, pentane, hexane, heptane and mixtures thereof are used alone or in admixture with other solvents such as ketones, liquid $SO_2$, and esters. Typical of prior art deasphalting processes is the process described in U.S. Pat. No. 2,337,448 in which a heavy residuum is deasphalted by contacting it at elevated temperature with a deasphalting solvent such as ethane, ethylene, propane, propylene, butane, butylene, isobutane, and mixtures thereof. Other solvents may be used in the process of this patent such as pentane, gasoline, mixtures of alcohol and ether, acetone and other solvents capable of dissolving the oil but not the asphaltenes. Most commonly, propane is used in deasphalting operations. However, propane deasphalting is somewhat limited in that it will extract only about 40 to 60% of a petroleum residuum and the bottom fraction resulting from propane deasphalting, and mounting to about half of the residuum, is unsuitable for use except as an ingredient in the blending and production of heavy fuel oils. Additional refining treatments must be employed in order to precipitate therefrom additional asphalt and to release more useful deasphalted oil from this bottoms fraction. Generally, the higher molecular weight aliphatic hydrocarbons such as pentane, hexane and heptane will result in a greater yield of deasphalted oil and produce asphalt with a higher softening point.

However, as one uses solvent of increasing molecular weight and/or boiling point, one loses the advantage of facile stripping under mild conditions obtainable with the autorefrigerant hydrocarbons such as propane.

SUMMARY OF THE INVENTION

It has now been found that asphalt-containing mineral oils can be deasphalted by contacting the oil with a liquid hydrogen sulfide deasphalting solvent for a time sufficient to precipitate a substantial portion of the asphalt from the oil and thereby form two liquid-liquid immiscible phases, a viscous oil phase dissolved in the solvent and an asphaltene phase containing some oil and solvent. The oil phase forms an upper layer while the asphaltene phase forms a lower layer, the upper and lower layers are separated from each other and deasphalted oil and asphalt recovered therefrom.

The essence of this invention resides in the use of liquid hydrogen sulfide as the deasphalting solvent. The somewhat autorefrigerant properties of liquid hydrogen sulfide, reflected in the relatively low boiling point (−75° F at atmospheric pressure), and subsequent high volatility result in facile separation of same from the oil and asphalt without incurring the relatively low deasphalted oil yield debit associated with the use of autorefrigerant hydrocarbons such as propane and propylene as deasphalting solvents.

The amount of liquid hydrogen sulfide deasphalting solvent employed and the operating temperatures utilized must be controlled to suit the particular oil feedstock being treated in order to obtain a deasphalted oil of the desired viscosity, Conradson carbon residue content, sulfur content and metals content. The pressure utilized in the deasphalting operation must, of course, be sufficient to maintain the hydrogen sulfide in the liquid state and is a function of temperature. It has been found that outside of maintaining the hydrogen sulfide in the liquid state, the effect of pressure on the deasphalting operation of the instant invention is relatively negligible.

The contacting step takes place at a temperature ranging from as low as −76° F up to just below the liquid hydrogen sulfide solvent critical temperature of 212° F and at a pressure ranging from about 0 to about 1300 pounds per square inch gage (psig). Preferable conditions are temperatures ranging from about 75° to 150° F and pressures of from about 200 to 600 psig. In general, the deasphalting can be carried out at solvent/feed liquid volume ratios ranging from as low as 1/1 up to 20/1 and higher. However, more preferbly, the ratio of solvent to oil feed will range from about 2/1 to about 10/1. As hereinbefore stated, the overall contacting operation results in the formation of two liquid-liquid immiscible phases forming two layers, an upper layer of viscous oil dissolved in the solvent and a lower layer of asphaltenes containing some oil and solvent. The upper layer is withdrawn from the asphaltene layer and then each layer or phase is sent to solvent recovery means such as flash evaporation, distillation and/or stripping to remove the solvent from the deasphalted oil and asphalt products.

The process of the instant invention is useful for removing asphalt from any mineral oil feedstock containing asphaltenes. Suitable feedstocks include whole and topped crudes as well as residual petroleum oil fractions having initial boiling points (at atmospheric pressure) ranging from about 650° to about 1100° F. Topped crudes are crude oils from which only the lighter boiling materials have been removed (i.e., including naphtha) and have an initial boiling point of about 400° F. It is particularly useful for treating atmospheric and vacuum residua. Preferably, the oil feedstock treated is a petroleum vacuum residuum having an initial atmospheric boiling point ranging from about 850° to 1050° F, a gravity from about 1° to 15° API, a viscosity ranging from about 400 to 10,000 SUS at 210° F and containing at least about 10 wt.% of materials boiling above 1050° F.

Contacting of the feed with the liquid hydrogen sulfide deasphalting solvent may be done on a batch basis or continuously, with the latter mode of operation being more preferred. The contacting may be carried out in one or more mixer-settler units or in a countercurrent liquid-liquid contacting tower. In the latter case, the feed enters the top of the tower and the liquid hydrogen sulfide solvent enters near the bottom. The tower is provided with internals such as packing, staggered rows of angle irons, liquid-liquid contacting trays, baffles and rotating disc contactors, etc. to provide efficient contacting of the solvent and feed. The solvent stream containing the dissolved, deasphalted oil rises through the tower passing by the feed stage and then usually through a zone provided with heating coils in order to reject some of the heavier components in the oil and also to promote reflux in the tower. The asphalt phase passes downwardly through the tower countercurrently through the bulk of the rising solvent and deasphalted oil stream and leaves through the bottom of the tower. As is typical of most deasphalting solvents, the solubility of the deasphalted oil in the liquid hydrogen sulfide decreases with increasing temperature.

The invention will be more readily understood by reference to the following examples.

EXAMPLE 1

In this example, a 1030° F+ Tia Juana vacuum residuum feed, shown in Table 1, was deasphalted using single stage batch deasphalting. The deasphalting temperature was 75° F. Liquid hydrogen sulfide deasphalting solvent was run at three different ratios of solvent to feed and was compared to results obtained by using pentane and heptane deasphalting solvents. In the case of the pentane and heptane runs, the feed had to be prediluted 1/1 with toluene in order to lower the viscosity thereof sufficient to provide adequate mixing of the aliphatic solvent with the feed in the batch unit. The results are listed in Table 2 and show that the use of a liquid hydrogen sulfide deasphalting solvent gave deasphalted oil yields that compared favorably both in quantity and quality with those resulting from the use of either pentane or heptane deasphalting solvents.

EXAMPLE 2

These experiments were run similar to those in Example 1 except that the asphalt-containing feed was a Cold Lake crude oil, the inspection properties of which are listed in Table 1. The results of these experiments are illustrated in Table 3 and show that liquid hydrogen sulfide may be satisfactorily used to deasphalt a whole crude oil as well as vacuum resids. In this case, the viscosity of the asphalt-containing oil feed was low enough so that predilution of the feed with toluene was not needed prior to contacting same with the aliphatic deasphalting solvents.

TABLE 1

| FEED PROPERTIES | TJM1 1030+ | Cold Lake Crude |
|---|---|---|
| API | 7.6 | 9.5 |
| CCR, Wt. % | 22.7 | 13.5 |
| Sulfur, Wt. % | 2.74 | 4.16 |
| Ni/V, wppm | 54/436 | 50/120 |
| Nitrogen, Wt. % | 0.76 | — |
| N-heptane insol, Wt. % | 15.8 | 12.1 |

TABLE 2

| DEASPHALTING TJM1 RESID Temperature, 24° C | | | | | |
|---|---|---|---|---|---|
| Run # | EX-10A[1] | EX-10A[1] | 13 | 14 | 15 |
| Deasphalting Conditions | | | | | |
| Solvent | $nC_5$ | $nC_7$ | $H_2S$ | $H_2S$ | $H_2S$ |
| Solvent/Oil, Vol. Ratio | 20 | 20 | 9 | 3.5 | 2.1 |
| Pressure, psig | 0 | 0 | 230 | 230 | 230 |
| Deasphalted Oil | | | | | |
| Yield, LV % (estimated) | — | — | 81 | 85.5 | 98 |
| Yield, Wt % | 79 | 84.2 | 78.6 | 83.3 | 97.8 |
| CCR, Wt. % | 12.7 | 15.1 | 17.0 | 18.4 | 22.3 |
| Sulfur, Wt. % | — | — | 3.57 | 3.05 | 3.11 |
| Ni/V, wppm | 13/107 | 23/183 | 12/133 | 23/215 | 43/388 |
| Asphalt | | | | | |
| Yield, Wt. % | 21.0 | 15.8 | 21.4 | 16.7 | 2.2 |
| CCR, Wt. % | — | — | 51.1 | 53.3 | 28.4 |
| Ni/V, wppm | — | — | 154/1200 | 147/1250 | 79.670 |

[1] 1/1 Resid/Toluene Feed.

TABLE 3

| DEASPHALTING COLD LAKE CRUDE | | | |
|---|---|---|---|
| Run # | EX-10A | EX-10A | EX-11 |
| Deasphalting Conditions | | | |
| Solvent | $nC_3$ | $nC_7$ | $H_2S$ |
| Temperature, ° C | 24 | 24 | 24 |
| Solvent/Oil, Vol. Ratio | 20 | 20 | 9 |
| Reactor | 1 | 1 | 3 |
| Pressure, psig | 0 | 0 | 230 |
| Deasphalted Oil | | | |
| Yield, Wt. % | 84.3 | 87.9 | 86.8 |
| CCR, Wt. % | 7.7 | 9.6 | 12.6 |
| Ni/V, wppm | 18/39 | 30/62 | 25/71 |
| Asphalt | | | |
| Yield, Wt. % | 15.6 | 12.1 | 13.2 |

What is claimed is:

1. A process for deasphalting an asphalt-containing mineral oil which comprises contacting said oil with a liquid hydrogen sulfide deasphalting solvent to form two liquid-liquid immiscible phases, a solvent phase containing deasphalted oil and an asphalt phase.

2. The process of claim 1 wherein said contacting is carried out at a temperature ranging from about −76° F to just below 212° F.

3. The process of claim 2 wherein said mineral oil is selected from the group consisting essentially of whole crude oils, topped crude oils and heavy petroleum oil fractions having an initial boiling point ranging from about 650° F to 1100° F at atmospheric pressure.

4. The process of claim 3 wherein said heavy petroleum oil fraction is a vacuum or an atmospheric residuum.

5. The process of claim 3 wherein the solvent/oil liquid volume ratio ranges from about 2 to 20.

6. A solvent deasphalting process which comprises contacting an asphalt-containing petroleum oil with a solvent consisting essentially of liquid hydrogen sulfide for a time sufficient to precipitate a substantial portion of said asphalt from said oil thereby forming two liquid-liquid immiscible phases, a solvent phase containing deasphalted oil and an asphalt phase, separating said phases and recovering a deasphalted oil from said solvent phase.

7. The process of claim 6 wherein said contacting is carried out at a temperature ranging from about −76° F to just below 212° F.

8. The process of claim 7 wherein said petroleum oil is selected from the group consisting essentially of whole crude oils, topped crude oils and heavy petroleum oil fractions having an initial boiling point ranging from about 650° F to 1100° F at atmospheric pressure.

9. The process of claim 8 wherein said heavy petroleum oil fraction is a vacuum or an atmospheric residuum.

10. The process of claim 8 wherein the ratio of solvent to oil ranges from 2 to 20.

* * * * *